US006197137B1

(12) United States Patent
Akahani et al.

(10) Patent No.: US 6,197,137 B1
(45) Date of Patent: Mar. 6, 2001

(54) METHOD OF PREVENTING ADHESION OF AQUATIC ORGANISMS IN STRUCTURES IN WATER

(75) Inventors: Kaoru Akahani, 77-8 Fukushima, Kurashiki-shi, Okayama-ken 710-0048, Kurashiki (JP); Masahiro Kikuchi, Osaka (JP)

(73) Assignee: Kaoru Akahani, Okayama-ken (JP)

( * ) Notice: Subject to any disclaimer, the term of this patent is extended or adjusted under 35 U.S.C. 154(b) by 0 days.

(21) Appl. No.: 09/261,219

(22) Filed: Mar. 3, 1999

(30) Foreign Application Priority Data

Mar. 3, 1998 (JP) ..... 10-069566

(51) Int. Cl.[7] ..... B63B 59/04

(52) U.S. Cl. ..... 156/71; 114/222; 156/212; 405/216; 428/907

(58) Field of Search ..... 156/71, 148, 212, 156/215; 405/216; 114/222, 361; 422/6; 428/907

(56) References Cited

U.S. PATENT DOCUMENTS 3,685,477 * 8/1972 Wood ..... 114/222
4,098,955 * 7/1978 Partridge ..... 405/216
5,226,380 * 7/1993 Fischer ..... 114/222

FOREIGN PATENT DOCUMENTS 59-134208 * 8/1984 (JP) ..... 405/216
63-22908 * 1/1988 (JP) ..... 114/222

* cited by examiner

*Primary Examiner*—Geoffrey L. Knable
(74) *Attorney, Agent, or Firm*—Arent, Fox, Kintner, Plotkin & Kahn

(57) ABSTRACT

The present invention provides a method of preventing adhesion of aquatic organisms on structures in the water such as ships. In the method, the underwater part of a structure in the water is covered up with the sheet. The sheet is made of a polyolefin and less than 1 mm thick, and has apertures each of which has a surface area of 1 to 60 $mm^2$, the surface area in total of the apertures occupying 20 to 80% of the entire surface area of the sheet. The sheet has a tensile strength of 15 to 37% as measured under JIS L1096A and a tear strength of 3 to 9 kg as measured under JIS L1096A-1.

3 Claims, 1 Drawing Sheet

METHOD OF PREVENTING ADHESION OF AQUATIC ORGANISMS IN STRUCTURES IN WATER

BACKGROUND OF THE INVENTION

1. Field of the Invention

The present invention relates to a method of preventing adhesion of aquatic organisms on structures in water, such as ships, and more particularly, to a method of preventing adhesion of aquatic organisms on underwater structures such as ships with easy operation, without landing of the structures and at a low cost.

2. Description of Prior Art

In the sea are floating larvae, spawn and seeds of aquatic organisms such as barnacles, shellfish, sea weeds and algae. These living things may adhere to underwater parts of moored ships such as fishing boats or leisure boats, and begin to grow up at these parts. The mooring for a long term causes shellfish to grow up in a large lump, which may damage the ship if left to stand as they are, thus considerably reducing the life of the ship. Furthermore, when ships navigate with aquatic organisms adhered to the underwater parts thereof, increased water resistance to the navigation may increase fuel cost and rolling of ships may hardly secure safe navigation.

It is actually impossible to mechanically scrape the bottom of ships in the water to remove the adhered aquatic organisms therefrom. Normally, the ships have to be landed for the scraping. This case necessitates lifting means such as a crane and a board space, so that the cost is increased and a great amount of manpower is required.

Thus, a method of preventing adhesion of aquatic organisms on ships has been required and many methods have been developed.

There is a method using a special paint for preventing the adhesion. This method requires ship landing for applying the paint to the bottom of ship, and furthermore, the paint duration is short. Also, use of such special paints has been objected in view of protection of environments, because some of the paints may include ingredients harmful to shellfish or human bodies.

JP Unexamined Patent Publication No. 7-96891 discloses one method of preventing adhesion of aquatic organisms on a ship without requiring landing of the ship. According to the method, the ship is wrapped at the underwater part thereof with a waterproof sheet, thereby reducing the salt content in sea water between the ship and the sheet to kill the spawn of shellfish. Another method was proposed in JP Unexamined Patent Publication No. 60-94892. In this method, the whole of a ship is covered with a light-untransmitting sheet, thereby inhibiting aquatic organisms from growing up on the ship. A still further method was proposed in JP Unexamined Patent Publication No. 4-50598. In this method, an air bag is slipped under the ship bottom, and the bag is inflated with air, so that it may be brought into close contact with the ship bottom. Thus, aquatic organisms are prevented from adhering to the ship bottom. These proposed methods are, however, not satisfactory, because they have some defects or inconvenience. In particular, they require a member having a unique shape made by stitching up or welding elements, and the operation of the member is hard due to its complicated shape when the member is set on the ship bottom. Furthermore, these methods require a great amount of labor cost.

Moreover, JP Unexamined Patent Publication No. 63-22908 discloses a method of preventing aquatic organisms from adhering to ship bottoms, in which underwater structures are covered with a cloth, net or porous sheet of 1 mm or more thick and having a space through which water can easily be replaced (see the claims). According to this publication, this sheet can hardly prevent aquatic organisms from the adhesion, if it has a thickness of less than 1 (see page 3, right-hand lower column, line 3 to page 4, left-hand upper column, line 2 of the publication). In fact, a great amount of aquatic organisms were adhered when the cloth sheet had a thickness of 0.5 mm in the Comparative Example.

Furthermore, this publication describes that the porous sheet may be made of, for example, a foamed polyurethane, foamed polystyrene, foamed polyethylene, etc., and these foams have a standard pore number of preferably 5 to 20 per 25 mm (see page 3, right-hand lower column, lines 12 to 17). Referring to the working examples of this publication, Example 1 used a polyurethane foam sheet of 10 mm thick as the porous sheet, Example 7 used a net made of polyethylene, and Example 8 used a porous reticulated structure made of synthetic fibers.

Thus, the porous sheet of the publication above is very thick. This should be called a plate rather than a sheet. Underwater structures of a large scale can very hardly be covered with such a plate-like sheet.

SUMMARY OF THE INVENTION

It is one object of the present invention to provide a method of preventing adhesion of aquatic organisms on structures such as ships without necessity of landing the structures, which overcomes the defect or inconvenience of the prior art and can easily be operated at a low cost.

DETAILED DESCRIPTION OF THE INVENTION

Figure 1A:
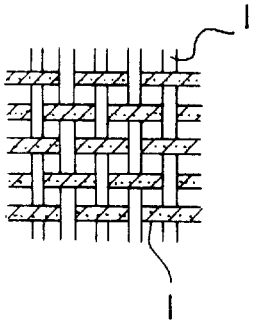
FIG. 1A is a schematic view illustrating the structure of a plain fabric sheet made of long strips, used in the present invention.

The prevent invention provides a method of preventing adhesion of aquatic organisms on a structure in water, such as a ship, by covering the underwater part of the structure with a polyolefin sheet of less than 1 mm thick and having apertures. Each of the apertures has an area of 1–60 $mm^2$. The total areas of the apertures occupy 20 to 80% of the entire area of the sheet.

In a preferred embodiment of the present invention, the above-mentioned polyolefin sheet has a tensile elongation of 15 to 37% as measured by the testing method of JIS L1096A and a tear strength of 3 to 9 kg as measured by the testing method of JIS L1096A-1. The sheet was made of long strips in a lattice form, and the crossings of the strips were fused.

Preferred Embodiments

According to an embodiment of the present invention, the underwater part of a structure placed in the water is covered up with a sheet having such a structure as illustrated below to prevent aquatic organisms from adhering to the structure. In the followings, an explanation will be given with taking a ship, which is one of the structures in the water, as an example.

The sheet useful herein has a great number of apertures or through-holes over the surface thereof.

Each of the apertures has a surface area of 1 to 60 $mm^2$. When each of the apertures has such a surface area, larvae of aquatic organisms do not adhere to the ship but the sheet, and grew up only on the sheet. It has been discovered that the larvae of aquatic living things do not pass through the sheet of the present invention. On the other hand, this sheet easily passes water therethrough. Therefore, water resistance to the sheet is small while the underwater part of the ship is being covered with the sheet. Thus, the covering is very easy. If the surface area of each of the apertures is above the upper limit of 60 $mm^2$, the larvae of aquatic organisms pass through the sheet and adhere to the ship, and thus the object of the present invention cannot be achieved. If the surface area is below the lower limit of 1 $mm^2$, on the other hand, the sheet is hard to pass water therethrough, so that water resistance to the sheet increases while the underwater part of the ship is being covered with the sheet. Thus, the handling of the sheet is undesirably poor. Preferably, each of the apertures has a surface area of 5 to 30 $mm^2$.

The apertures have a surface area in total of 20 to 80% of the entire surface area of the sheet. If the surface area is above the upper limit, then the strength of the sheet is reduced, so there is such a risk that the sheet may be broken in water. Furthermore, undesirably the sheet does not have a surface area sufficient to allow the larvae of aquatic organisms to grow up. If the surface area is below the lower limit, on the other hand, the sheet does not have a sufficient ability to pass water therethrough, and the covering of the ship becomes hard due to increased water resistance. Preferably, the apertures have a surface area in total of 35 to 65% of the entire surface area of the sheet.

The sheet of the present invention is less than 1 mm thick, preferably within the range of not less than 0.05 mm to less than 1 mm thick. If the thickness is above the upper limit, then the covering of the ship with the sheet is hard. If the thickness is below the lower limit, then the strength of the sheet is too small to cover the ship. The thickness of the sheet is more preferably within the range of 0.2 to 0.5 mm.

The sheet has a tensile elongation of 15 to 37% as measured by the method of JIS L1096A and a tear strength of 3 to 9 kg as measured by the method of JIS L1096A-1. If the tensile elongation and the tear strength are smaller than the respective lower limits, then the sheet may be broken while the ship is being covered with the sheet or when the aquatic organisms grow up in a large lump and gain weight. If the tensile elongation and the tear strength are larger than the respective upper limits, it is disadvantageous in view of cost.

Materials for the sheet may suitably be a polyolefin such as polyethylene, polypropylene and polyvinyl chloride, because these materials are waterproof, good in weathering, sufficiently strong and flexible, and further easy to be worked, and inexpensive.

The polyolefin sheet may be made by methods normally used and perforated by any optional methods.

The polyolefin sheet may preferably be made by arranging long strips in a lattice form and then fusing the crossing points of the strips. The long strips may be yarns, strings, cords or tapes having a length sufficient to make the sheet of the present invention.

One polyolefin sheet made of the long strips as mentioned above is preferably stacked over another sheet having the same or similar structure, so that the long strips of the two sheets may obliquely cross each other and be fused to each other at the crossing points.

Figure 1B:
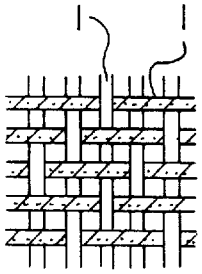
FIG. 1B is a schematic view illustrating the structure of a twilled cloth sheet made of long strips, used in the present invention.
Figure 1C:
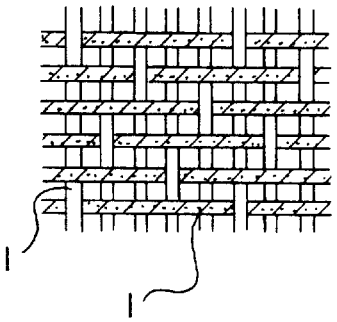
FIG. 1C is a schematic view illustrating the structure of a satin-woven sheet made of long strips, used in the present invention.

The way of assembling the long strips is not limited, but these strips should be arranged in a lattice form. For example, the long strips 1 are made in a plain fabric form, twilled form or satin-woven form, as shown in FIGS. 1A, 1B and 1C, respectively.

The width of each of the long strips and the interval between the long strips are not limited, provided that they satisfy the requirements of the surface area of each of the apertures, the ratio of the total surface area of the apertures to the entire surface area of the sheet, the tensile strength and the tear strength. For example, the width of each of the long strips may be within the range of 2 to 4 mm, and the interval between the long strips may be within the range of 1 to 5 mm both in longitudinal and transverse directions of the sheet. Furthermore, the width and the interval both are not required to be constant, as long as the requirements mentioned above are satisfied. The arrangement of the long strips in a lattice form may be such that vertical and horizontal long strips cross each other at a right angle as well as such that these long strips cross each other obliquely.

As is clear from the foregoing, the present invention provides a method of preventing aquatic organisms from adhering to moored ships by covering the underwater part of the ship with the sheet satisfying the requirements as mentioned above. In the present invention, the way of covering a ship is not limited, but the entire underwater part should be covered with the sheet at the end.

In one embodiment of the present invention, the entire underwater part of a ship is covered with one of the sheets as mentioned above in such a manner as mentioned below. The end of the sheet is slid from one side (or bow) of the ship down into the bottom of the ship in the water, and then pulled at the opposite side (or stern) up above the surface of the water, so that the sheet is wrapped around the entire underwater part of the ship.

In another embodiment of the present invention, in which a ship cannot be covered with one sheet, it is covered with some sheets, for example, in such a manner as mentioned below. A belt-like sheet having a given width is slid down from one side (or bow) of the ship down into the bottom of the ship in the water, and then pulled at the opposite side (or stern) up above the surface of the water. One or more the same sheets are passed along the underwater part of the ship. Then two of these sheets are arranged so that they overlap each other at the sides thereof. The two belt-like sheets thus arranged are bound to each other with adhesive tapes, adhesives or strings in such a manner that no gaps are produced between the sheets. By repeating this operation with every two sheets, one large sheet is formed. Then, the entire underwater part of the ship is wrapped in the large sheet. The belt-like sheets may be bound by the same operation on land to obtain one large sheet in advance and the large sheet may be slid into the water likewise to cover the underwater part of the ship.

Since the sheet of the present invention passes a large amount of water, the water resistance against the sheet is reduced to a large extent compared with a sheet not passing water therethrough. Therefore, the amount of labor for covering ships with the sheet of the present invention can advantageously be reduced. Similarly, the amount of labor for removing the sheet from the ship can be reduced.

The sheet was fixed at the periphery thereof to parts of the ship body or some other structures with a rope or belt, while the entire periphery of the sheet is maintained above the surface of the water.

In the present invention, the sheet is not required to be maintained in close contact with the surface of the ship when covering the ship. The sheet and the ship may be separated from each other in such a distance that it does not give any inconvenience in mooring or working. The sheet may be moved in water by the power of waves, and hence the sheet is separated from the ship surface at some distance. The distance is preferably about 1 to 10 cm.

When the ship covered with the sheet as mentioned above is moored for a long time, the sheet has aquatic organisms adhered thereto. The aquatic organisms increase in their amount and gradually grow up. The increased weight of the aquatic organisms causes the sheet to hang down. Thus, supporting the sheet perfectly by fixing only at the periphery thereof may be difficult in view of the strength of the sheet. In such a case, therefore, the sheet may be supported by stronger ropes or belts stretched under the sheet at a suitable interval, or lifted by the buoyant force of a tube(s) made of a synthetic resin or rubber, stretched under the sheet and inflated with air. Furthermore, before covering the ship, one adhesive side of cut pieces of a pressure sensitive adhesive double coated tape may be stuck on the sheet at a suitable interval. The other adhesive side of the cut pieces may be stuck to the surface of the ship in the covering, thereby strengthening the support of the sheet.

When the ship is to leave a port, the sheet can easily be removed from the ship. Furthermore, the removed sheet can again be used as it is if the adhered amount of the aquatic organisms is small.

The method of preventing adhesion of aquatic organisms according to the present invention can also be applied to structures other than ships. The structures include floating piers, underwater culture equipment and floating culture equipment, equipment for excavating submarine oil fields, floating lamps for guiding ships, floating lighthouses, buoys, floating heliports, ropes placed on the sea or in the sea for various purposes etc. These structures, as well as ships, can be protected from adhesion of aquatic organisms by covering the whole underwater parts with the sheet(s) of the present invention and by fixing the sheet(s).

EXAMPLE

An outboard leisure boat of 2 m wide and 11 m long, made of a fiber-reinforced plastic was used for testing. Said boat was moored at a shore in Kishiwada-shi, Osaka. It was covered with a sheet comprising long strips arranged in a lattice form and fused at the crossing points thereof to form apertures. Each of the apertures had a surface area of 6 $mm^2$. The total surface area of the apertures occupied 45% of the entire surface area of the sheet. The thickness of the sheet was 0.3 mm. The sheet had a tensile elongation of 22% as measured under JIS L1096A and a tear strength of 7.5 kg as measured under JIS L1096A-1. For the purpose of comparison, a hole in a rectangular shape of 20 cm×60 cm was cut in the sheet to make a portion of the underwater part of the boat which was not covered. The boat was moored for six month from March of 1998. Thereafter, said sheet was removed, and the boat was landed. The condition of the boat was observed to know whether aquatic organisms were adhered to the boat.

No materials such as aquatic organisms were found on the boat and the sheet surface facing to the boat, while a mass of barnacles and muddy materials were found on the non-covered portion of the boat and the sheet surface not facing to the boat. The portion of the boat on which the mass of barnacles was found was the same in size as the cut-off part of the sheet. Thus, it was confirmed that any aquatic organisms did not adhere to the boat when the ship was covered with the sheet of the present invention but, on the other hand, they adhered to the non-covered portion of the boat The method of the present invention can effectively prevent aquatic organisms from adhering to underwater structures such as underwater parts of ships by covering the structures with the sheet of the present invention.

As can be seen from the foregoing, the method of the present invention can be carried out without landing structures to be protected from adhesion of aquatic organisms. Therefore, the method of the present invention does not require securing a space and machines such as a crane needed for landing, and can be carried out anywhere the ship is moored. Furthermore, the present invention requires a smaller amount of manpower. Therefore, the labor cost can be saved.

The sheet of the present invention has a great number of apertures and hence can pass a large amount of water therethrough. This means that the water resistance to the sheet in the covering and the removing in the water is small. Therefore, the present invention requires a much smaller amount of labor than the prior art. Furthermore, the present invention does not require bringing the sheet into close contact with ships. Therefore, the covering is easier.

Since the sheet of the present invention comprises long strips arranged in a lattice form, it has a higher tensile elongation and tear strength. Therefore, it can be made thinner while being maintained at the strength sufficient to sustain the sheet. Thus, the sheet of the present invention is light in weight, not bulky in a folded state and easy to handle. A large deposit place is not required. Moreover, the sheet of the present invention can be made at a low cost, because the structure is not complex and the long strips in a lattice form are only fused at the crossing points thereof.

The sheet of the present invention is made of a polyolefin, and hence the used sheet does not produce any toxic gases when burned as waste. Therefore, it is friendly to the environment.

What is claimed is:

1. A method of preventing adhesion of aquatic organisms on a structure in water, which comprises covering the structure with a sheet made of a polyolefin and of less than 1 mm thick having apertures each of which has a surface area of 1 to 60 $mm^2$, the surface area in total of said apertures occupying 20 to 80% of the entire surface area of said sheet.

2. The method recited in claim 1, wherein said structure is an underwater part of a ship.

3. The method recited in claim 1, wherein said sheet has a tensile strength of 15 to 37% as measured under JIS L1096A and a tear strength of 3 to 9 kgs as measured under JIS L1096A-1.

* * * * *